US008245722B2

(12) United States Patent
Huang et al.

(10) Patent No.: US 8,245,722 B2
(45) Date of Patent: Aug. 21, 2012

(54) INFLATION NOZZLE CAPABLE OF CONNECTING WITH TWO TYPES OF TIRE VALVES

(76) Inventors: Ying-Che Huang, Sioushuei Township, Changhua County (TW); Chun-Ming Huang, Sioushuei Township, Changhun County (TW)

( * ) Notice: Subject to any disclaimer, the term of this patent is extended or adjusted under 35 U.S.C. 154(b) by 388 days.

(21) Appl. No.: 12/625,008

(22) Filed: Nov. 24, 2009

(65) Prior Publication Data

US 2011/0123262 A1 May 26, 2011

(51) Int. Cl.
*F16K 15/20* (2006.01)

(52) U.S. Cl. ..... 137/223; 137/231

(58) Field of Classification Search ..... 137/223, 137/231, 227, 228, 230, 232, 798; 285/353, 285/355

See application file for complete search history.

(56) References Cited

U.S. PATENT DOCUMENTS

| | | | | |
|---|---|---|---|---|
| 4,088,147 | A * | 5/1978 | Krechel et al. | 137/223 |
| 6,276,391 | B1 * | 8/2001 | Wu | 137/223 |
| 6,382,268 | B1 * | 5/2002 | Lin | 137/231 |
| 7,309,034 | B2 * | 12/2007 | Huang | 239/589 |
| 7,588,048 | B2 * | 9/2009 | Huang | 137/231 |
| 7,661,435 | B2 * | 2/2010 | Huang | 137/231 |
| 7,963,297 | B2 * | 6/2011 | Huang et al. | 137/231 |
| 2006/0027299 | A1 * | 2/2006 | Keller | 137/231 |
| 2008/0271789 | A1 * | 11/2008 | Huang | 137/231 |
| 2010/0019491 | A1 * | 1/2010 | Huang et al. | 285/344 |

* cited by examiner

*Primary Examiner* — Craig Schneider
*Assistant Examiner* — Craig J. Price
(74) *Attorney, Agent, or Firm* — Muncy, Geissler, Olds & Lowe, PLLC

(57) ABSTRACT

An inflation nozzle includes a first part having a first threaded passage defined centrally therethrough and a connection ring is threadedly connected to a first end of the first part. An insertion is formed on a second end of the first part and is engaged with a first chamber of a central member which is received in a second part. The central member is connected with a tire pump. The first passage is sized to be connected with a French valve and the connection ring is sized to be connected with an American valve.

7 Claims, 9 Drawing Sheets

INFLATION NOZZLE CAPABLE OF CONNECTING WITH TWO TYPES OF TIRE VALVES

BACKGROUND OF THE INVENTION

1. Field of the Invention

The present invention relates to an inflation nozzle capable of connecting with two types of tire valves, and more particularly, to an inflation nozzle of a tire pump capable of connecting with a French valve and an American valve.

2. The Prior Arts

Referring to FIG. 1, a conventional French inflation nozzle 40 of an inflation device, such as a tire pump, threadedly connects with a corresponding French valve 60. The French valve 60 includes an inlet end 63, a second threaded portion 62 disposed by the inlet end 63 and a first threaded portion 61 disposed by the second threaded portion 62. The first threaded portion 61 has a diameter and a length larger than those of the second threaded portion 62. The French inflation nozzle 40 includes a casing 41, a cap 42 and a central member 50. The central member 50 includes a chamber 51 defined in an inside thereof which communicates with a guide hose 52 which is connected with the tire pump or a flexible tube of the tire pump (not shown). The chamber 51 has a diameter larger than that of the guide hose 52. A stepped portion is defined at the conjunction portion of the chamber 51 and the guide hose 52. The cap 42 is mounted onto the stepped portion and includes a circular hole 421 through which the guide hose 52 extends. The cap 42 includes outer threads 422. A tubular valve plug 43 made of rubber is received in the chamber 51. The second threaded portion 62 of the French valve 60 is inserted into a central passage of the valve plug 43. A step portion formed between the first threaded portion 61 and the second threaded portion 62 is pressed against the valve plug 43, so as to form an air-tight connection. The casing 41 includes inner threads 412 which are threadedly connected with the outer threads 422 of the cap 42. Connection threads 411 are defined in an end of the casing 41. Thus, the French valve 60 can be inserted into the valve plug 43 and the first threaded portion 61 is threaded with the connection threads 411. Moreover, the French valve 60 is pressed against the valve plug 43, thereby providing air sealing feature. By the connection, air can be supplied via the guide hose 52 and inflate the tire (not shown) via the French valve 60.

Nevertheless, as disclosed in FIG. 2, the French inflation nozzle 40 cannot inflate a tire with an American valve 70, because the American valve 70 has a threaded portion larger than the hole defined in the connection threads 411 of the French inflation nozzle 40. The French inflation nozzle 40 is threadedly connected to the French valve 60 so that it provides better air-tight connection and the pressurized air can be used to inflate the tire. An American inflation nozzle is simply snapped to the American valve 70. Therefore, if the pressure in the tire increases, the American inflation nozzle may be pushed to separate from the American valve 70. The American inflation nozzle is not suitable to connect with a high pressure tire pump such as a carbon dioxide high pressure tire pump. This problem that no inflation nozzle is able to connect with the two different types of tire valves causes troubles for the cyclists for a long time.

SUMMARY OF THE INVENTION

A primary objective of the present invention is to provide an inflation nozzle that can connect with both a French tire valve and an American tire valve. Another objective of the present invention is to provide an inflation nozzle that is threadedly connected with the two different types of tire valves.

In order to achieve the objective, an inflation nozzle according to the present invention comprises a central member which has a first end with a guide hose connected thereto and a first chamber is defined in a second end of the central member. A first part has a first threaded passage defined centrally therethrough. A first space is defined in a first end of the first part and a second threaded passage is located by the first space. A first outer connection portion is formed on an outer surface of the first part. A first insertion is formed on a second end of the first part and inserted in the first chamber in the central member to form an air-tight connection. A second part has a second inner connection portion defined in a first end thereof and a second chamber is defined within the second part. A through hole is defined through a second end of the second part. The central member extends through the through hole of the second part and is engaged with the second chamber. The second inner connection portion of the second part is connected with the first outer connection portion of the first part. The first threaded passage and the second threaded passage are different sizes and suitable for the French valve and the American valve, respectively.

The central member connects the first and second parts to make the inflation nozzle to be simple and compact. The seal ring ensures that no air escapes between the first and second parts. The first and second threaded passages are designed to be connected with the French valve and the American valve.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 3:
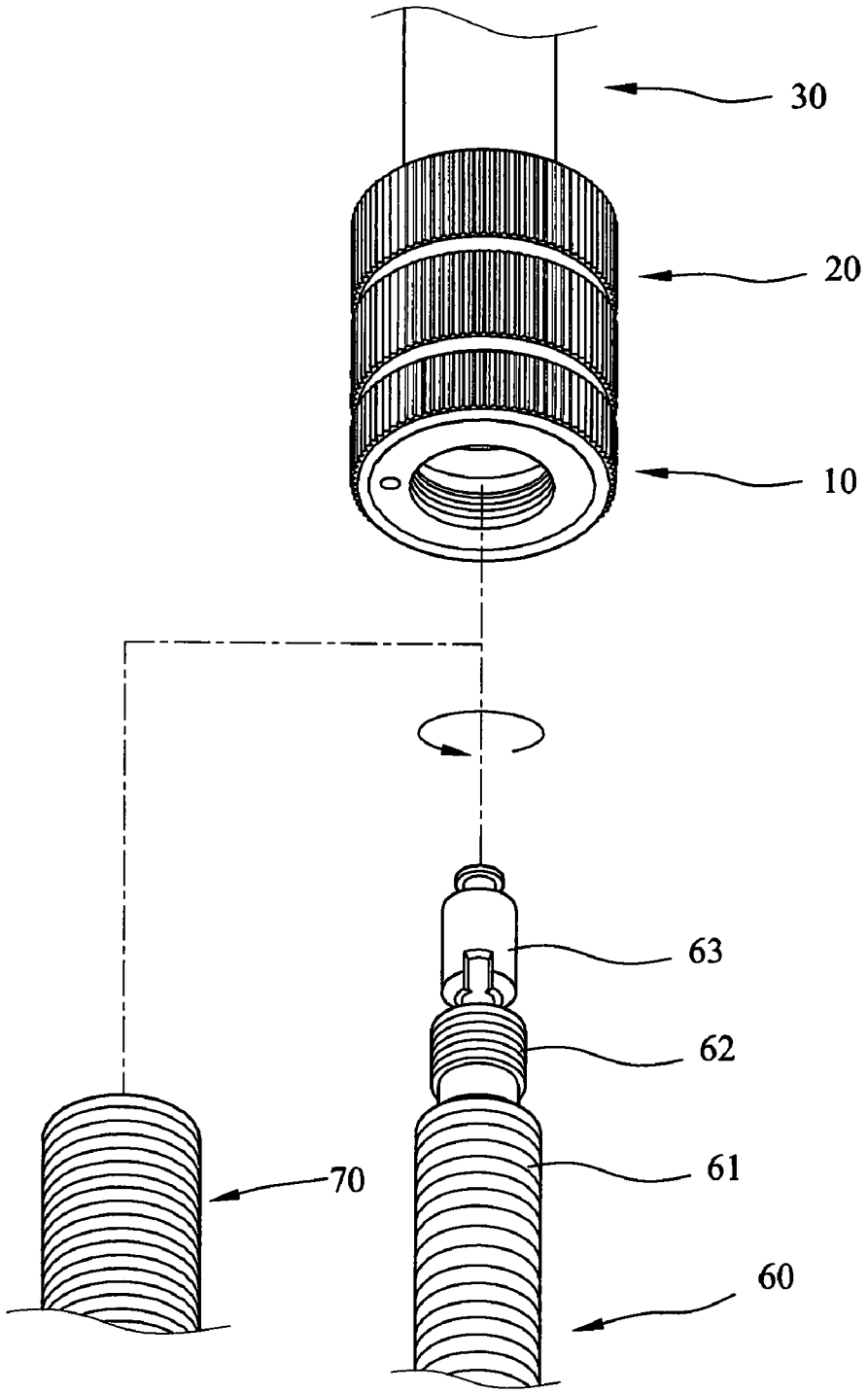
FIG. 3 is a perspective view showing an inflation nozzle according to the present invention, a French valve and an American valve.
Figure 4:
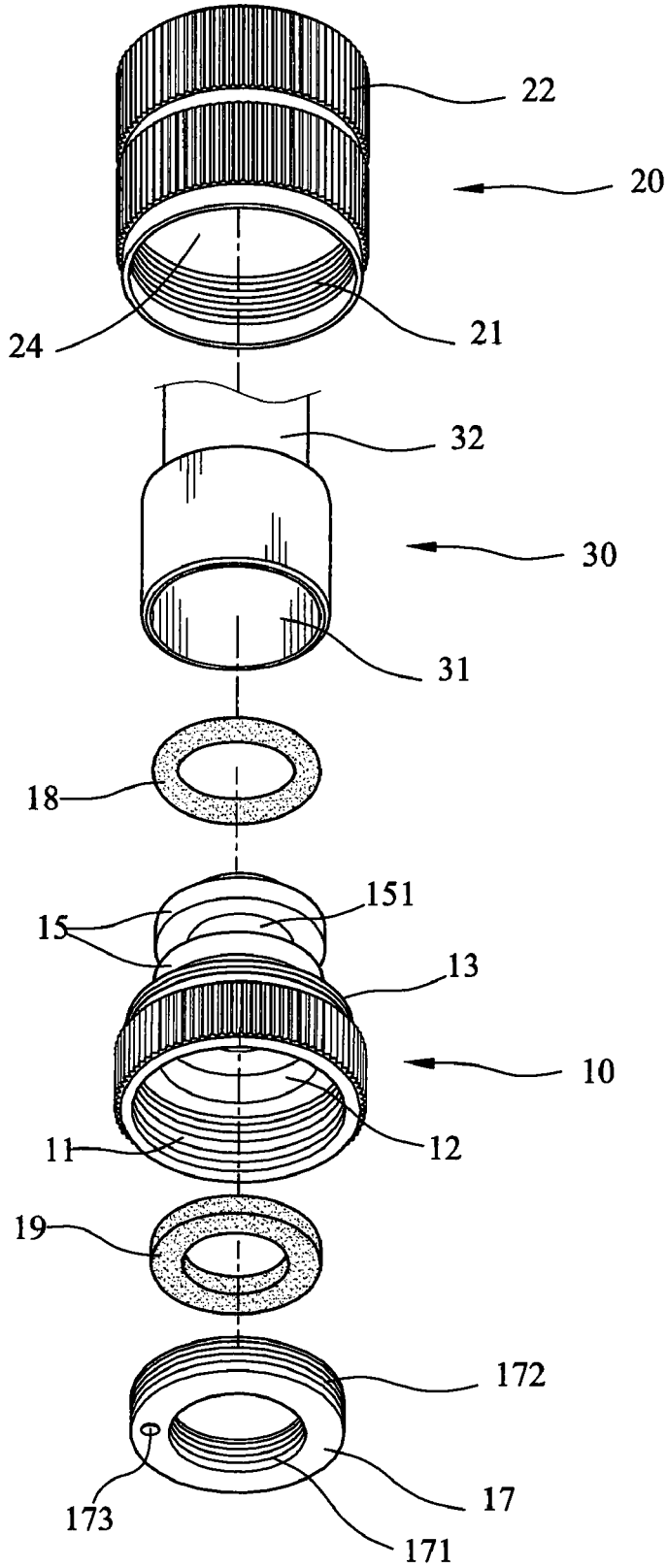
FIG. 4 is an exploded view showing the inflation nozzle according to the present invention.
Figure 5:
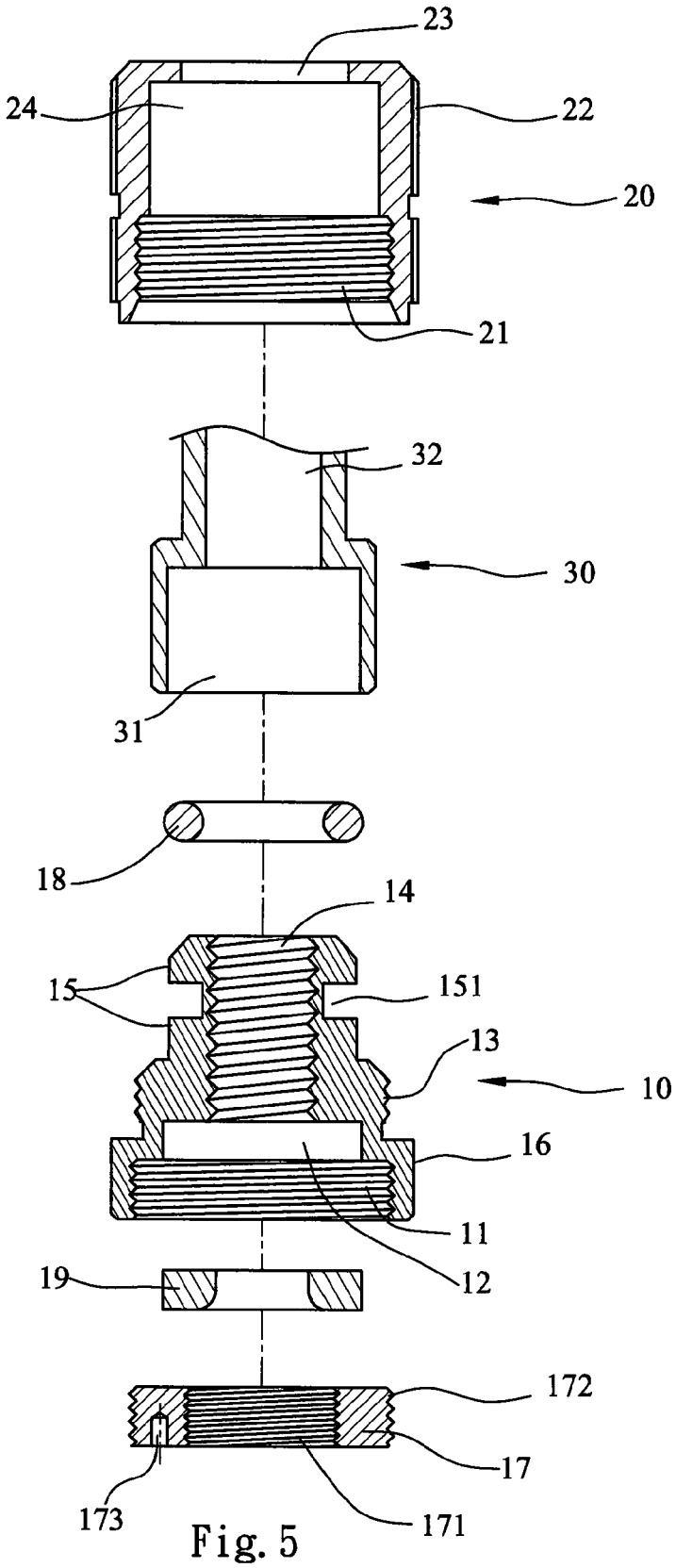
FIG. 5 is a cross sectional exploded view showing the inflation nozzle according to the present invention.

FIG. 3 illustrates an inflation nozzle according to the present invention, a French valve 60 and an American valve. The French valve 60 includes an inlet end 63, a second threaded portion 62 disposed by the inlet end 63 and a first threaded portion 61 disposed by the second threaded portion 62. With reference to the drawings and in particular to FIGS. 3 to 5, the inflation nozzle is designed to be threadedly connected to the second threaded portion 62 of the French valve 60 and the American valve 70. The inflation nozzle according to the present invention includes a central member 30 having a first end with a guide hose 32 connected thereto and a first chamber 31 is defined in a second end of the central member 30. A first part 10 has a first threaded passage 14 defined centrally therethrough and a first space 12 is defined in a first end of the first part 10. A seal ring 19 is received in the first space 12 and a connection ring 17 is threadedly connected to a first inner connection portion 11 by a second outer connection portion 172 defined in the outer surface of the connection ring 17. A second threaded passage 171 is defined through the connection ring 17 and located with the first space 12. An operation hole 173 is defined in an underside of the connection ring 17 such that the user can use a tool to engage with the operation hole 173 to rotate the connection ring 17, thereby separating the connection ring 17 from the first inner connection portion 11. The seal ring 19 is received in the first space 12 and a first outer connection portion 13 is formed on an outer surface of the first part 10. A first insertion 15 is formed on a second end of the first part 10 and includes a second space 151 defined on an outer periphery thereof, a seal ring 18 is engaged with the second space 151. A serrated surface 16 is defined on an outer surface of the first end of the first part 10 such that the user can easily rotate the first part 10. The first insertion 15 is inserted in the first chamber 31 in the central member 30 and a diameter and a height of the first insertion 15 is smaller than a diameter and depth of the first chamber 31 of the central member 30. An outer periphery of the seal ring 18 is larger than a diameter of the first insertion 15 so as to be sealed relative to the first chamber 31 to form an air-tight connection.

A second part 20 has a second inner connection portion 21 defined in a first end thereof and a second chamber 24 defined within the second part 20. A through hole 23 is defined through a second end of the second part 20. The guide hose 32 of the central member 30 extends through the through hole 23 of the second part 20 and the central member 30 is engaged with the second chamber 24. The second inner connection portion 21 of the second part 20 is connected with the first outer connection portion 13 of the first part 10. A serrated surface 22 is defined on an outer surface of the second part 20 such that the user can easily rotate the second part 20.

It is noted that the first threaded passage 14 and the second threaded passage 171 being different sizes, the first threaded passage 14 is sized to be connected with a French valve 60 and the second threaded passage 171 is sized to be connected with an American valve 70.

Figure 1:
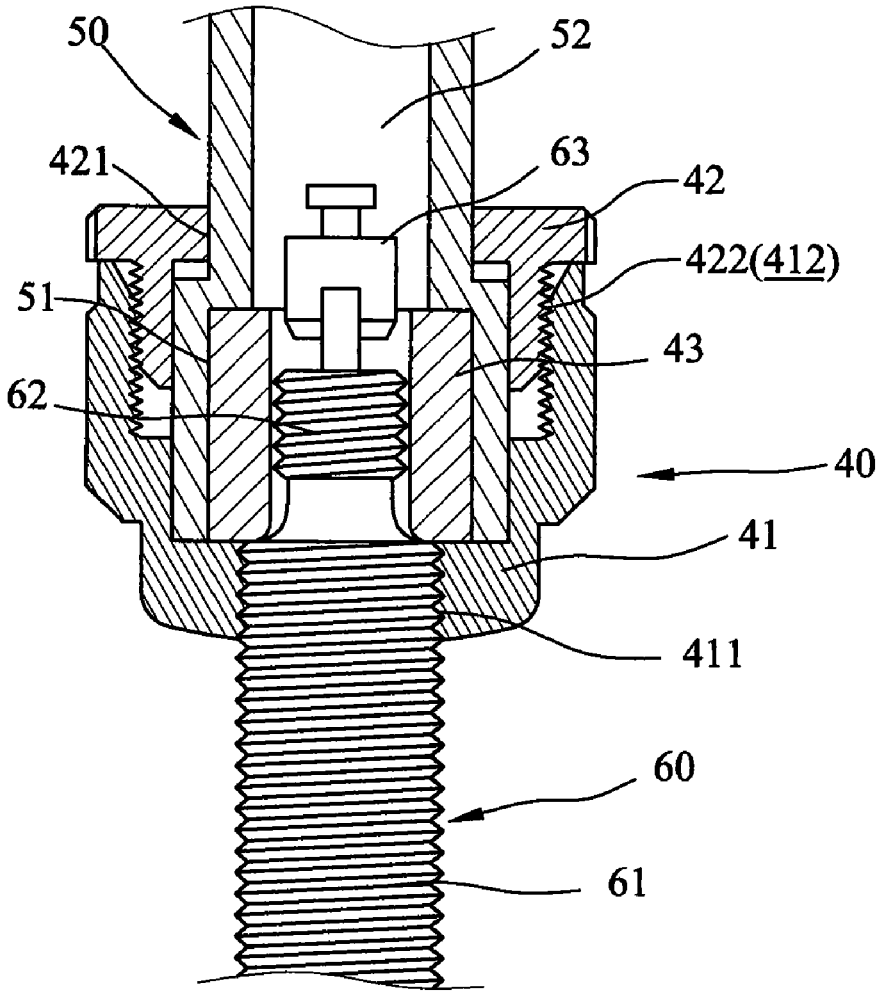
Fig. 1 (Prior Art)
FIG. 1 is a cross sectional view showing a conventional French inflation nozzle connected with a French valve.
Figure 2:
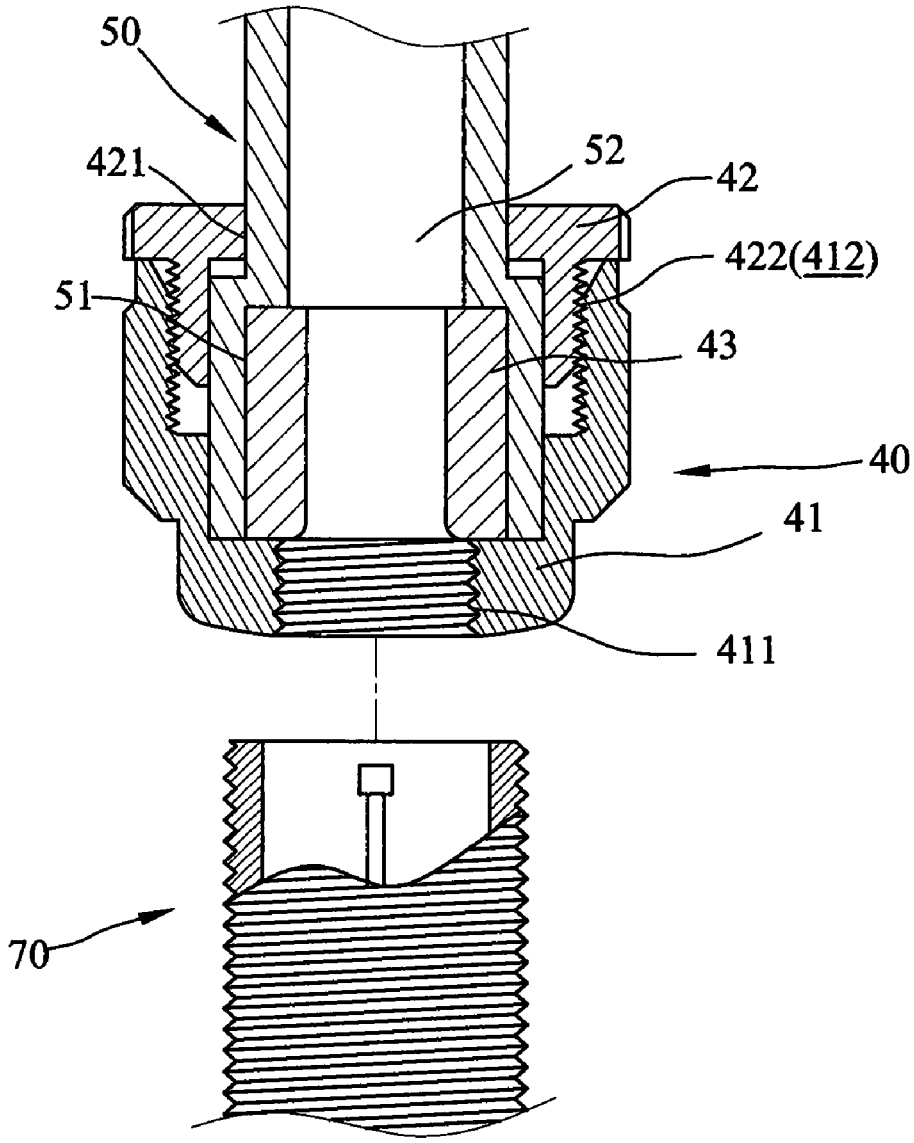
Fig. 2 (Prior Art)
FIG. 2 is a cross sectional view showing the conventional French inflation nozzle unable to connect with an American valve.
Figure 6:
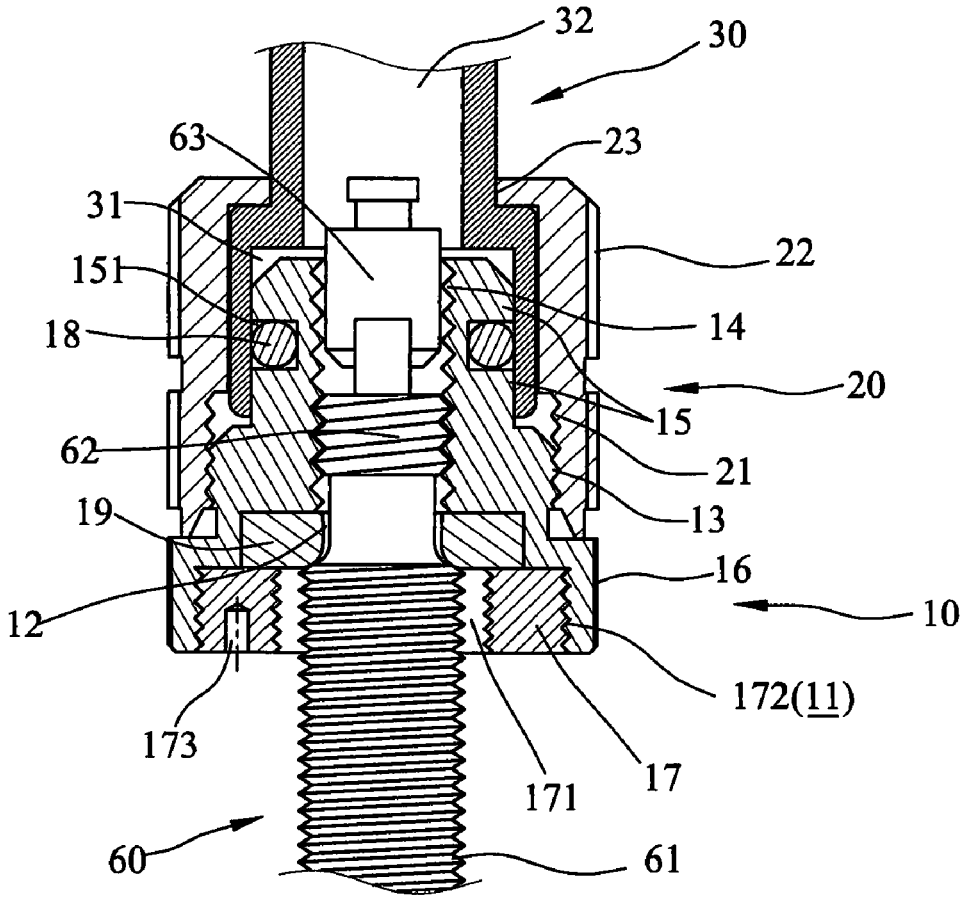
FIG. 6 is a cross sectional view showing the inflation nozzle according to the present invention connected with the French valve.
Figure 7:
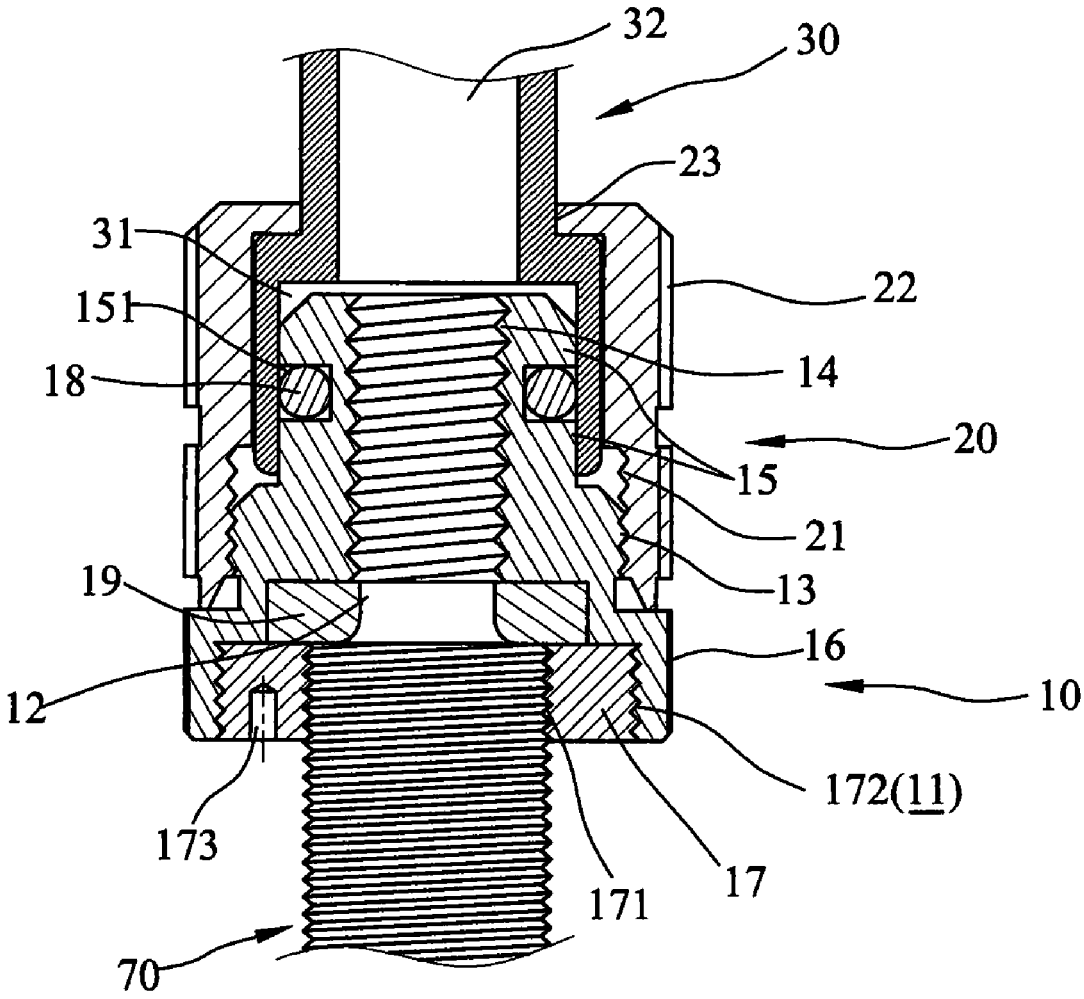
FIG. 7 is a cross sectional view showing the inflation nozzle according to the present invention connected with the American valve.

As shown in FIGS. 6 and 7, the second threaded portion 62 of the French valve 60 as shown in FIG. 1 extends through the connection ring 17 and is threadedly connected to the first threaded passage 14, and the stepped surface between the first and second threaded ends 61, 62 of the French valve 60 is in contact with the seal ring 19 to form an air-tight connection. Therefore, the air from the tire pump (not shown) is pumped into the tire (not shown) via the central member 30. The American valve 70 can be connected with the second threaded passage 171 and sealed by the seal ring 19 to inflate the tire.

Figure 8:
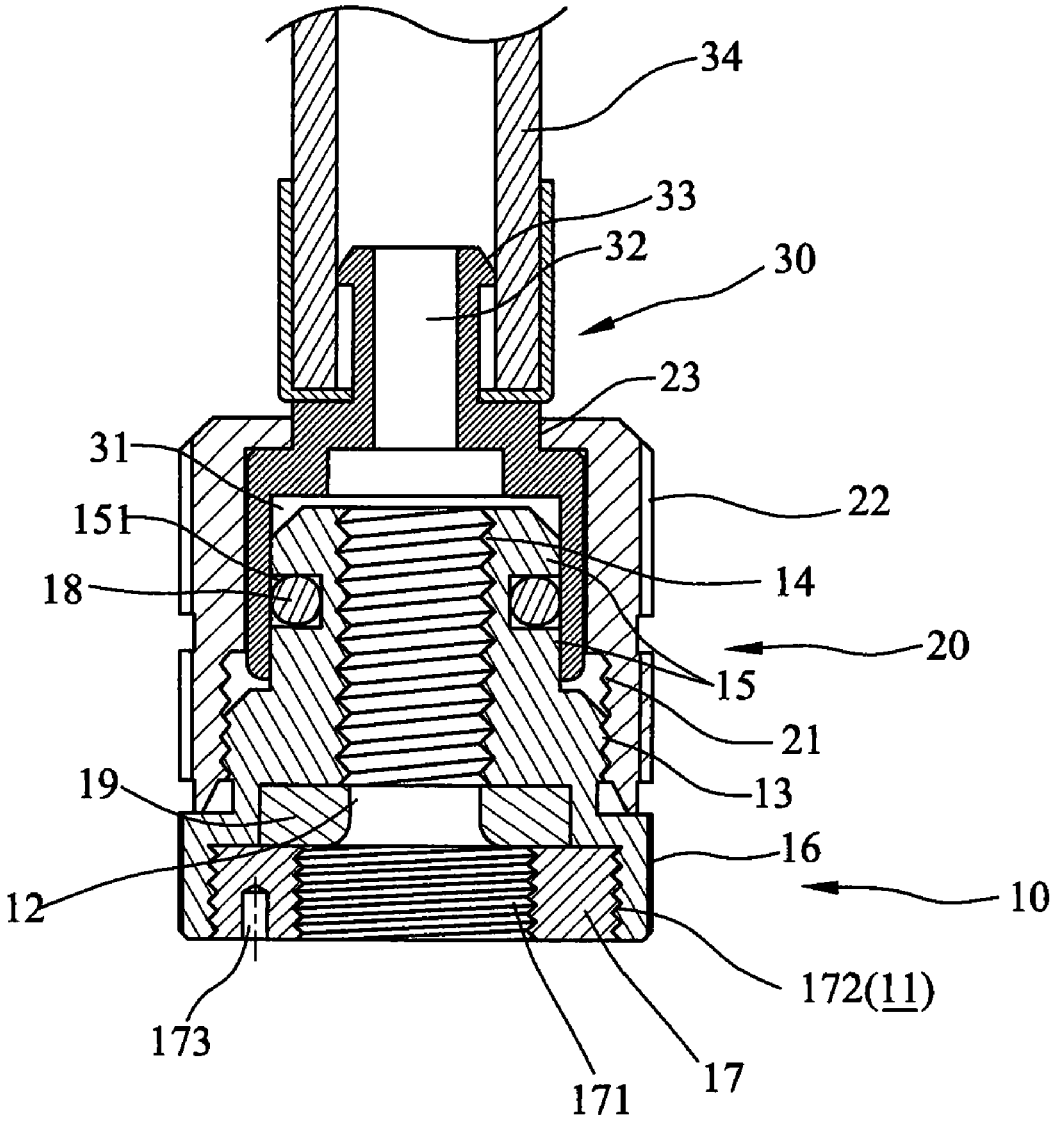
FIG. 8 is a cross sectional view showing the inflation nozzle according to the present invention connected with a hose from a tire pump.
Figure 9:
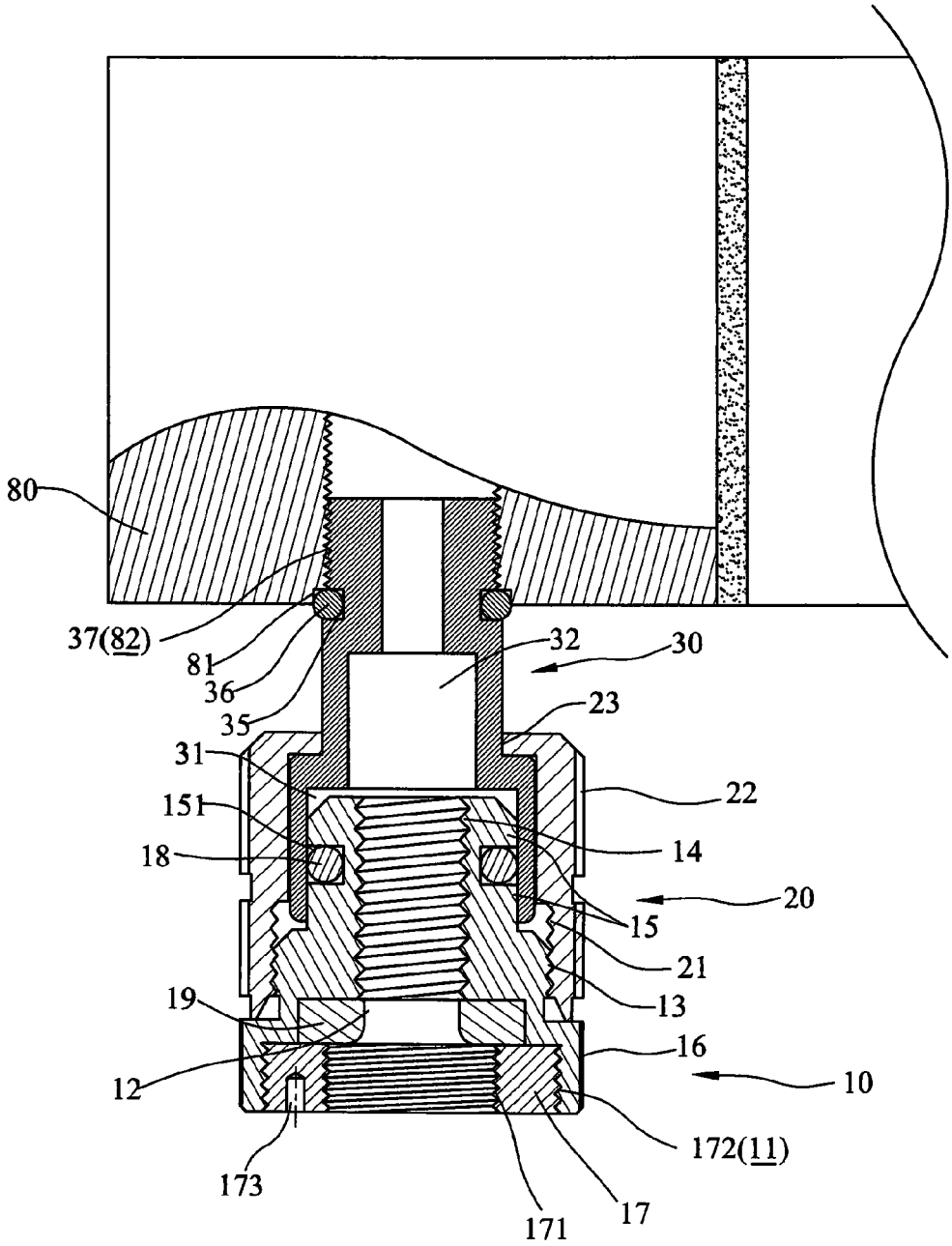
FIG. 9 is a cross sectional view of the inflation nozzle of the present invention directly connected with a tire pump.

FIG. 8 shows that the central member 30 includes a second insertion 33 which is connected with a soft hose 34 from the tire pump. FIG. 9 shows that the central member 30 has a groove 35 with which another seal ring 36 is engaged. The central member 30 includes a threaded end 37 which can be directly and threadedly connected to the threaded port 82 of the tire pump 80. A recessed area 81 is defined in the threaded port 82 and the seal ring 36 is engaged with the recessed area 81 to prevent from leakage. The positions of the threaded end 37 and the threaded port 82 can be changed as needed.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An inflation nozzle capable of connecting with two types of tire valves, comprising:

a central member having a first end with a guide hose connected thereto and a first chamber defined in a second end of the central member;

a first part having a first threaded passage defined centrally therethrough, a first space defined in a first end of the first part and a second threaded passage located by the first space, a seal ring received in the first space and a first outer connection portion formed on an outer surface of the first part, a first insertion formed on a second end of the first part, the first insertion inserted in the first chamber in the central member to form an air-tight connection; and a second part having a second inner connection portion defined in a first end thereof, a second chamber defined within the second part and a through hole defined through a second end of the second part, the central member extending through the through hole of the second part and engaged with the second chamber, the second inner connection portion of the second part connected with the first outer connection portion of the first part;

wherein a first inner connection portion is defined in the first end of the first part and a connection ring is threadedly connected to the first inner connection portion, the second threaded passage is defined through the connection ring; and wherein each of the first threaded passage and the second threaded passage has a size corresponding to the two types of the tire valves, respectively.

2. The inflation nozzle as claimed in claim 1, wherein the first insertion includes a second space defined on an outer periphery thereof and a seal ring is engaged with the second space.

3. The inflation nozzle as claimed in claim 1, wherein the first threaded passage is capable of connecting with a French valve.

4. The inflation nozzle as claimed in claim 1, wherein the second threaded passage is capable of connecting with an American valve.

5. An inflation nozzle capable of connecting with two types of tire valves, comprising:

a central member having a first end with a guide hose connected thereto and a first chamber defined in a second end of the central member;

a first part having a first threaded passage defined centrally therethrough, a first space defined in a first end of the first part and a second threaded passage located by the first space, a seal ring received in the first space and a first outer connection portion formed on an outer surface of the first part, a first insertion formed on a second end of the first part; and a second part having a second inner connection portion defined in a first end thereof, a second chamber defined within the second part and a through hole defined through a second end of the second part, the central member extending through the through hole of the second part and engaged with the second chamber, the second inner connection portion of the second part connected with the first outer connection portion of the first part;

wherein a diameter and a height of the first insertion are respectively smaller than a diameter and a depth of the first chamber of the central member, a seal ring is mounted to the first insertion and an outer periphery of the seal ring is larger than a diameter of the first insertion so as to be sealed relative to the first chamber; and wherein a first inner connection portion is defined in the first end of the first part and a connection ring is threadedly connected to the first inner connection portion, the second threaded passage is defined through the connection ring.

6. The inflation nozzle as claimed in claim 5, wherein the first insertion includes a second space defined on an outer periphery thereof and a seal ring is engaged with the second space.

7. The inflation nozzle as claimed in claim 5, wherein the first threaded passage and the second threaded passage has a size corresponding to the two types of the tire valves, respectively.

* * * * *